US010792529B2

(12) United States Patent
Li

(10) Patent No.: US 10,792,529 B2
(45) Date of Patent: Oct. 6, 2020

(54) FITNESS EQUIPMENT AND FITNESS SYSTEM BASED ON FITNESS EQUIPMENT

(71) Applicant: Guangze XIANG, Wenzhou, Zhejiang (CN)

(72) Inventor: Hong Li, Zhejiang (CN)

(73) Assignee: Guangze Xiang, Wenzhou (CN)

( * ) Notice: Subject to any disclaimer, the term of this patent is extended or adjusted under 35 U.S.C. 154(b) by 40 days.

(21) Appl. No.: 16/132,236

(22) Filed: Sep. 14, 2018

(65) Prior Publication Data

US 2019/0009122 A1 Jan. 10, 2019

Related U.S. Application Data

(63) Continuation of application No. PCT/CN2017/076913, filed on Mar. 16, 2017.

(30) Foreign Application Priority Data

Mar. 16, 2016 (CN) ..... 2016 1 0156157

(51) Int. Cl.

| | |
|---|---|
| ***A63B 21/005*** | (2006.01) |
| ***A63B 21/00*** | (2006.01) |
| ***A63B 71/06*** | (2006.01) |
| ***A63B 24/00*** | (2006.01) |
| ***A63B 23/02*** | (2006.01) |

(52) U.S. Cl.

CPC ..... *A63B 21/0052* (2013.01); *A63B 21/005* (2013.01); *A63B 21/00072* (2013.01); *A63B 21/4045* (2015.10); *A63B 24/0062* (2013.01); *A63B 24/0075* (2013.01); *A63B 24/0087* (2013.01); *A63B 71/0622* (2013.01); *A63B 23/0244* (2013.01); *A63B 2024/0078* (2013.01); *A63B 2220/13* (2013.01); *A63B 2220/20* (2013.01); *A63B 2225/096* (2013.01); *A63B 2225/15* (2013.01); *A63B 2225/20* (2013.01); *A63B 2225/50* (2013.01)

(58) Field of Classification Search

CPC ..... A63B 21/0052; A63B 24/0075; A63B 24/0062; A63B 71/0622; A63B 21/4045; A63B 21/005; A63B 24/0087; A63B 21/00072; A63B 2024/0078; A63B 2220/20; A63B 2225/50; A63B 2225/096; A63B 2225/15; A63B 23/0244; A63B 2225/20; A63B 2220/13; A63B 2230/00; A63B 71/0619

See application file for complete search history.

(56) References Cited

U.S. PATENT DOCUMENTS

2012/0053014 A1* 3/2012 Zhu ..... A63B 21/00069 482/5

2015/0190669 A1* 7/2015 Matsuura ..... A63B 21/02 482/8

* cited by examiner

*Primary Examiner* — Sundhara M Ganesan

(74) *Attorney, Agent, or Firm* — Wayne & Ken, LLC; Tony Hom

(57) ABSTRACT

Disclosed is a fitness equipment including a fitness equipment terminal and a data terminal. The fitness equipment terminal includes a movable member and a damping device for controlling the damping intensity of the movable member, and also includes a travel tracking module for feeding back motion data of the damping device and a control module for controlling the damping device. The damping device includes an electromagnetic induction assembly. A fitness system is also disclosed.

9 Claims, 3 Drawing Sheets

FITNESS EQUIPMENT AND FITNESS SYSTEM BASED ON FITNESS EQUIPMENT

CROSS-REFERENCE TO RELATED APPLICATIONS

This application is a continuation of International Application No. PCT/CN2017/076913, filed on Mar. 16, 2017 which claims the benefit of priority from Chinese Application No. 201610156157.2, filed on Mar. 16, 2016. The content of the aforementioned applications, including any intervening amendments thereto, are incorporated herein by reference.

TECHNICAL FIELD

The present disclosure relates to a fitness equipment, and also relates to a fitness system based on the fitness equipment.

BACKGROUND

There are many kinds of fitness equipment. Each kind of fitness equipment is also different in exercise directions and use effects, but the principle is to exercise human local muscle or tissue through a damping device. However, most of the damping devices of ordinary fitness equipment are mechanical transmission structures; and resistance sources of damping systems may be counterweight, elastic ropes, springs, cylinders or pneumatic cylinders. Such resistance sources are difficult to change corresponding damping intensity at any time according to travel points. The damping intensity on a reciprocating travel is often a constant value or a constant curve. In heavy duty exercise, muscle strain is often caused in an initial travel; and physical energy is wasted. More refined local muscle strengthening exercise cannot be realized.

In addition, when a user makes an action exercise on a travel, its effective exercise is only a section on the travel with respect to the exercise goal. However, in the prior art, a complete set of actions shall be completed, thereby producing a part of idle work. This exercise mode consumes the physical strength of the user with low exercise efficiency and may exercise tissue parts which do not need the exercise.

Therefore, a fitness equipment capable of freely and flexibly changing the damping intensity at any time on a motion travel is required to be provided. In the exercise process, the value of the damping intensity can be flexibly adjusted with respect to physical qualities, exercise goals and exercise phases of different users.

People of different ages have different physical qualities and different exercise goals, so it is difficult to find an exercise method suitable for everyone. Even the same sports equipment has different use requirements for different persons.

The existing common sports venues are often provided with different kinds of sports equipment and can achieve a variety of different exercise modes. Because different exercise modes respectively focus on different points, professional fitness guidance is needed in order to make full and reasonable use of different exercise modes to exercise bodies. This professional fitness guidance is generally achieved by hiring a fitness trainer currently.

The fitness trainer usually has scientific knowledge of fitness theories and the ability to judge human body constitution. Therefore, in a gym, the fitness trainer will tailor a fitness scheme suitable for the fitter based on the condition of the body of the fitter and the characteristics of each fitness equipment. To ensure fitness quality, the fitness trainer also needs to supervise the fitness of the fitter according to the fitness scheme if possible, and to advise the fitter or to adjust the fitness scheme in real time according to the condition of the fitter. The fitness trainer also needs to have good communication skills, to urge the fitter to exercise strictly according to the fitness scheme. This service mode is highly dependent on the trainer and has high cost.

SUMMARY

Based on the above problems, the present disclosure aims to provide a fitness equipment capable of flexibly changing a damping value on a reciprocating motion travel according to different exercise schemes to realize refined fitness solutions and combinations of high degrees of freedom in various exercise programs.

Based on the above fitness equipment, the present disclosure also proposes a fitness system matched with the fitness equipment having a damping device. The fitness system can provide a customized exercise scheme according to the actual situation of the user, so as to get rid of an over-reliance on fitness trainers in the prior art. The user can realize fitness datamation, intelligentization and rapidity through the fitness system.

In view of the problems of the fitness equipment, the present disclosure provides the following technical solution: A fitness equipment includes a fitness equipment terminal and a data terminal. The fitness equipment terminal includes a movable member and a damping device for controlling the damping intensity of the movable member, and also includes a travel tracking module for feeding back motion data of the damping device and a control module for controlling the damping device. The damping device includes an electromagnetic induction assembly. The electromagnetic induction assembly includes a stator core, a plurality of magnetic induction coils disposed in a lengthwise direction in the stator core, and a rotor damping shaft located at one side of the plurality of magnetic induction coils. The rotor damping shaft is connected to the movable member of the fitness equipment and is configured to control the damping intensity of the movable member. A plurality of rotor magnets having magnetisms disposed oppositely in sequence are disposed on the rotor damping shaft. The rotor damping shaft realizes reciprocating motion through electrification of the plurality of magnetic induction coils. The travel tracking module is used for tracking motion data of the rotor damping shaft and feeding back the data to the control module. The data terminal is used for transmitting a fitness scheme to the control module. The control module controls the motion of the damping device according to the fitness scheme transmitted by the data terminal. In the process that the damping device of the fitness system makes reciprocating motion along with the movable member, an electromagnetic force is produced through electrification of the plurality of magnetic induction coils, so as to drive the rotor damping shaft to move relatively. Current magnitudes and directions of the plurality of magnetic induction coils are changed to control the travel, the direction and the generated damping intensity of the rotor damping shaft, so as to change the damping intensity of the movable member on the motion travel at any time to adapt to many actual exercise demands of the user under complicated conditions. Compared with the traditional fitness equipment, the present disclosure has higher degree of freedom and can adjust refined fitness schemes.

The present disclosure is further configured as follows: the fitness equipment also includes a posture adjustment module for automatically adjusting positions of components of the fitness equipment to adjust a sitting posture of a user; and the control module controls and adjusts the posture adjustment module according to the fitness scheme. Before the user takes exercise, the posture adjustment module can adjust the positions of the components of the fitness equipment according to the data of the fitness scheme of the user, to adapt to the user to achieve a best exercise effect.

The present disclosure is further configured as follows: the fitness equipment also includes a terminal display module configured to remind the user in real time in the motion process. The terminal display module is configured to display the exercise condition of the user in the exercise process to give an exercise reminder in time.

The present disclosure is further configured as follows: the travel tracking module includes an electronic ruler and a position sensor which track the motion condition of the rotor damping shaft, so as to transmit the data to the control module to monitor the exercise condition of the user.

The present disclosure is further configured as follows: a power-off protection device is also disposed between the rotor damping shaft and the stator core. The power-off protection device includes an electromagnetic switch on the rotor damping shaft and the stator core, and a buckling groove snap-fitted with ends of the electromagnetic switch, respectively. A plurality of buckling grooves are disposed on the stator core in a direction of the rotor damping shaft. When the power is off, the rotor damping shaft is lack of the damping force; and the power-off protection devices can lock the rotor damping shaft in time to avoid causing sudden injury to the user due to self weight and inertia of the movable member and the equipment.

In view of the problems of the fitness system, the prevent invention provides the following technical solution: the above fitness equipment is adopted; and the data terminal includes a data collection unit, a fitness scheme disposal unit and a fitness guidance unit.

The data collection unit is used for collecting data for identity information of the user.

The fitness scheme disposal unit is used for receiving the identity information of the user, generating and storing a fitness scheme corresponding to the identity information according to the identity information, and adjusting the fitness scheme corresponding to the identity information in combination with the motion data when receiving the motion data corresponding to the identity information.

The fitness guidance unit is used for recognizing the identity information of the user and acquiring the fitness scheme corresponding to the identity information from the fitness scheme disposal unit.

The present disclosure is further configured as follows: the fitness scheme disposal unit is arranged on a remote cloud and is in communication connection with the fitness guidance unit; the fitness guidance unit includes an identity information recognition module, a local storage module and a local processing module; after the identity information recognition module recognizes the identity information of the user, the corresponding fitness scheme acquired from the fitness scheme disposal unit is stored in the local storage module; and the local processing module conducts preprocessing of the control module of the fitness equipment terminal according to the fitness scheme of the local storage module.

The present disclosure is further configured as follows: the fitness scheme disposal unit includes a cloud storage module used for storing the identity information to be collected by the data collection unit, and a cloud processing module used for producing a fitness scheme according to the identity information of the user and storing the scheme into the cloud storage module.

The present disclosure is further configured as follows: the fitness guidance unit also includes a manual adjustment module for adjusting the fitness scheme in the form of manual intervention.

The present disclosure is further configured as follows: the fitness system also includes a data feedback unit for feeding back fitness progress data of the user; and the data feedback unit acquires data from the cloud storage module. The fitness progress data of the user can be known by a trainer in real time through the unit, so as to conduct refined fitness guidance on the user.

The present disclosure is further configured as follows: the fitness guidance unit also includes a guidance display module connected to the local processing module.

The present disclosure is further configured as follows: the fitness equipment includes a plurality of fitness equipment terminals connected to the local processing module of the fitness guidance unit.

The present disclosure has the following beneficial effects: relative to the prior art, the fitness system can customize a refined fitness scheme aiming to the identity information of the user, when the user makes fitness motion, the fitness guidance unit can recognize the identity information of the user, and acquire the corresponding fitness scheme from the fitness scheme disposal unit, and match with a flexible damping system. In the motion process, the user can make fitness motion targetedly according to fitness demands, so as to achieve efficient and refined fitness.

Meanings of numerals in the figures: 1: stator core; 2: rotor damping shaft; 3: magnetic induction coil; 4: position sensor; 5: electronic ruler; 6: buckling groove; 7: electromagnetic switch; and 8: rotor magnet.

DETAILED DESCRIPTION

Specific embodiments of the present disclosure are further described in detail below in combination with drawings and embodiments. The following embodiments are used for describing the present disclosure, but not used for limiting the scope of the present disclosure.

Figure 1:
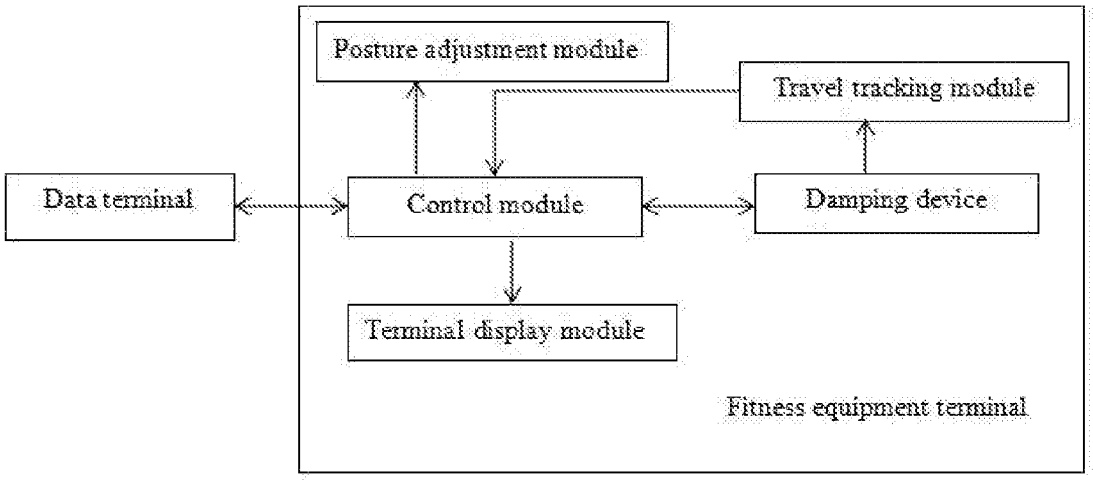
FIG. 1 is a principle block diagram of the fitness equipment in an embodiment of the present disclosure.
Figure 2:
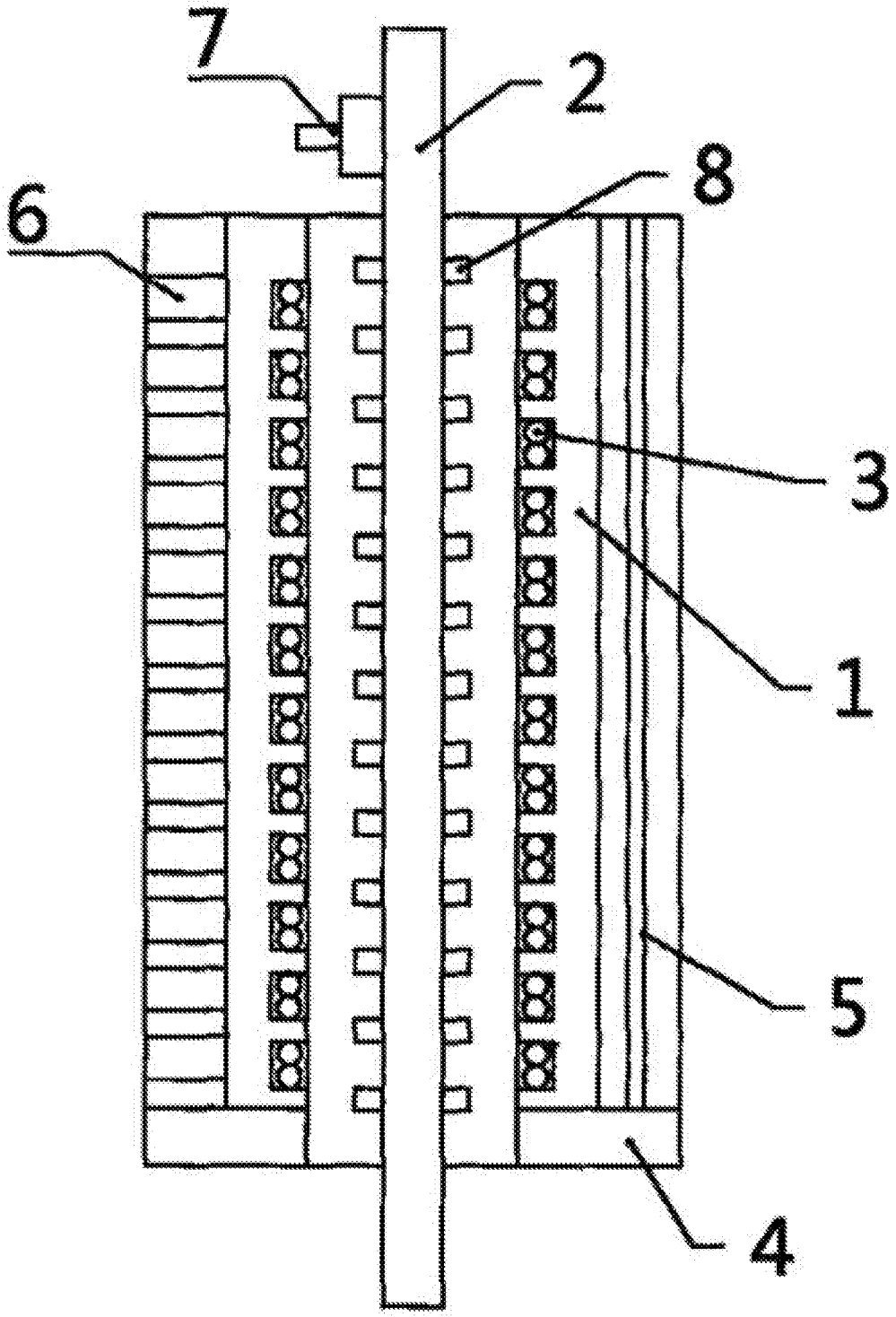
FIG. 2 is a schematic diagram of a structural principle of the damping device in an embodiment of the present disclosure.

As shown in FIG. 1 and FIG. 2, a fitness equipment includes a fitness equipment terminal and a data terminal. The fitness equipment terminal includes a movable member and a damping device for controlling the damping intensity of the movable member, and also includes a travel tracking module for feeding back motion data of the damping device and a control module for controlling the damping device. The damping device includes an electromagnetic induction assembly. The electromagnetic induction assembly includes a stator core 1, a plurality of magnetic induction coils 3 disposed in a lengthwise direction in the stator core 1, and a rotor damping shaft 2 located at one side of the plurality of magnetic induction coils 3. The rotor damping shaft 2 is connected to the movable member of the fitness equipment and is configured to control the damping intensity of the movable member. A plurality of rotor magnets 8 having magnetisms disposed oppositely in sequence are disposed on the rotor damping shaft 2. The rotor damping shaft 2 realizes reciprocating motion through electrification of the plurality of magnetic induction coils 3. The travel tracking module is used for tracking motion data of the rotor damping shaft 2 and feeding back the data to the control module. The data terminal is used for transmitting a fitness scheme to the control module. The control module controls the motion of the damping device according to the fitness scheme transmitted by the data terminal. In the process that the damping device of the fitness system makes reciprocating motion along with the movable member, an electromagnetic force is produced through electrification of the plurality of magnetic induction coils 3, so as to drive the rotor damping shaft 2 to move relatively. Current magnitudes and directions of the plurality of magnetic induction coils 3 are changed to control the travel, the direction and the generated damping intensity of the rotor damping shaft 2, so as to change the damping intensity of the movable member on the motion travel at any time to adapt to many actual exercise demands of the user under complicated conditions. Compared with the traditional fitness equipment, the present disclosure has higher degree of freedom and can adjust refined fitness schemes.

The present embodiment also includes a posture adjustment module for automatically adjusting positions of components of the fitness equipment to adjust a sitting posture of a user; and the control module controls and adjusts the posture adjustment module according to the fitness scheme. Before the user takes exercise, the posture adjustment module can adjust the positions of the components of the fitness equipment according to the data of the fitness scheme of the user, to adapt to the user to achieve a best exercise effect.

The present embodiment also includes a terminal display module configured to remind the user in real time in the motion process. The terminal display module is configured to display the exercise condition of the user in the exercise process and different travel points of the electromagnetic induction assembly in motion. The terminal display module can be used for synchronous display to give an exercise reminder in time, e.g., low motion speed and motion travel unrealized.

The travel tracking module in the present embodiment includes an electronic ruler 5 and a position sensor 4, which track the motion condition of the rotor damping shaft 2, so as to transmit the data to the control module to monitor the exercise condition of the user. The electronic ruler 5 and the position sensor 4 are configured to track the exercise condition in combination with the intensity change and the feedback data so as to automatically recognize proper intensity and rate.

A power-off protection device is also disposed between the rotor damping shaft and the stator core 1 in the present embodiment. The power-off protection device includes an electromagnetic switch 7 located on the rotor damping shaft 2 and the stator core 1, and a buckling groove 6 snap-fitted with ends of the electromagnetic switch 7, respectively. A plurality of buckling grooves 6 are disposed on the stator core 1 in a direction of the rotor damping shaft 2. When the power is off, the rotor damping shaft 2 is lack of the damping force; and the power-off protection devices can lock the rotor damping shaft 2 in time to avoid causing sudden injury to the user due to self weight and motion inertia of the movable member and the equipment.

In the above solution, the rotor damping shaft 2 of the electromagnetic induction assembly can adjust the motion travel, the intensity and the direction, and feed back the motion data to the control module through the travel tracking module, to analyze the exercise data of the user. In an exercise process, the user needs to exercise natural extension state and natural contraction state of partial muscle of the body, thereby determining an optimal effective motion travel of an exerciser. The electromagnetic induction assembly sets the optimal motion travel and has different damping intensities in different positions of the travel according to the fitness scheme, so as to achieve optimal exercise efficiency.

The most reasonable intensity can be configured according to the most effective section of travel of extension and contraction of local muscle of the body of an exercise target in the entire motion travel. Meanwhile, the exercise intensity of other travel sections is reduced; physical output is reduced; and an exercise effect of high efficiency of a local targeted section is obtained. The intensity of the entire travel can be automatically reduced during an initial warm-up period, so that the body gradually adapts to the exercise and is protected. The entire motion intensity is reduced at the end time period of the exercise, so that the body is well recovered in the motion to exercise other projects. Different intensities of training are automatically adjusted according to exercise needs. The present disclosure has diverse combinations of multiple degrees of freedom.

Meanwhile, in the fitness equipment of the present embodiment, the rotor damping shaft 2 is not limited to a straight travel, and corresponding adjustment (such as a curve) can be made according to practical fitness equipment.

Figure 3:
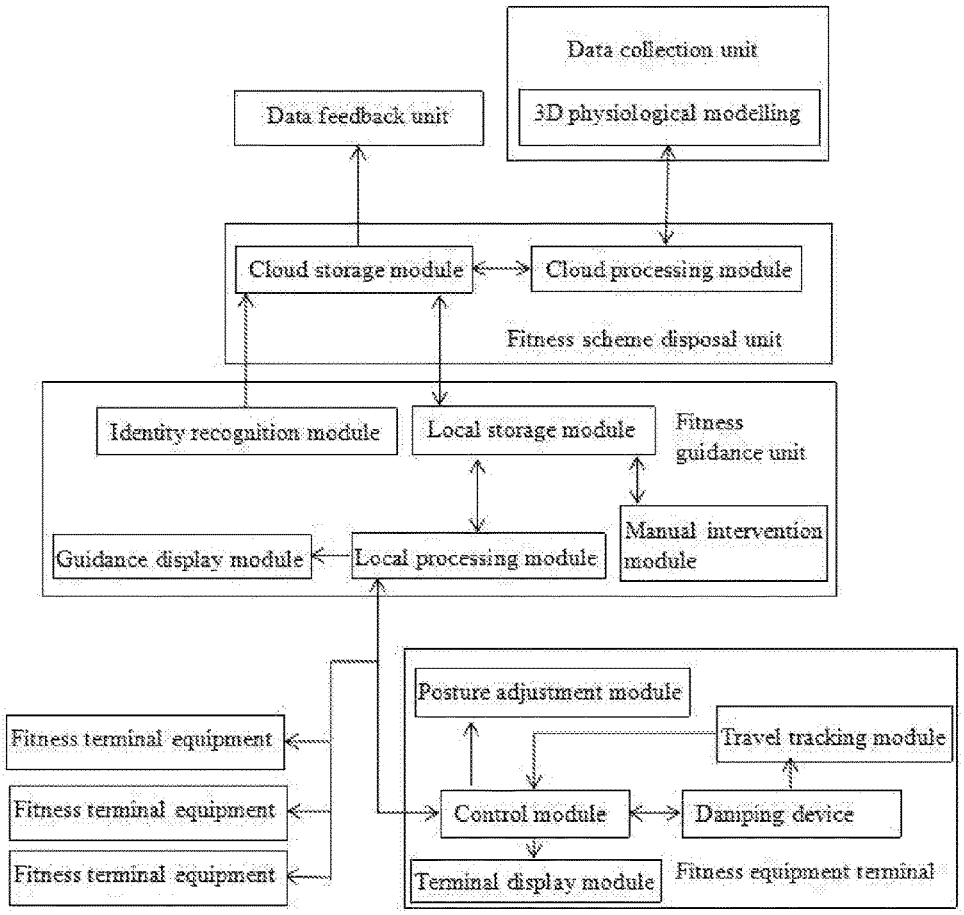
FIG. 3 is a schematic diagram of a structural principle of the fitness system in an embodiment of the present disclosure.

As shown in FIG. 3, in view of the problems of the fitness system, the prevent invention provides the following technical solution: the above fitness equipment is adopted; and the data terminal includes a data collection unit, a fitness scheme disposal unit, a fitness guidance unit and a plurality of fitness equipment terminals connected to the local processing module of the fitness guidance unit.

The data collection unit is used for collecting data for identity information of the user, including gender, age, height, weight, length diameters of limbs, head, trunk ratio, BWH and other personal data. The 3D physiological modelling module conducts 3D human body modeling in a computer for simulating human true motion, analyzing the distribution of muscle groups, fat and other tissues and simulating musculoskeletal motion to optimize an exercise effect.

The fitness scheme disposal unit is used for receiving the identity information of the user, generating and storing a fitness scheme corresponding to the identity information according to the identity information, and adjusting the fitness scheme corresponding to the identity information in combination with the motion data when receiving the motion data corresponding to the identity information. The fitness scheme disposal unit includes a cloud storage module used for storing the identity information to be collected by the data collection unit, and a cloud processing module used for producing a fitness scheme according to the identity information of the user and storing the scheme into the cloud storage module.

The fitness guidance unit is used for recognizing the identity information of the user and acquiring the fitness scheme corresponding to the identity information from the fitness scheme disposal unit. In the present disclosure, the fitness scheme disposal unit is arranged on a remote cloud and is in communication connection with the fitness guidance unit. The fitness guidance unit includes an identity information recognition module, a local storage module and a local processing module. After the identity information recognition module recognizes the identity information of the user, the corresponding fitness scheme acquired from the fitness scheme disposal unit is stored in the local storage module. The fitness guidance unit also includes a manual adjustment module for adjusting the fitness scheme in the form of manual intervention. Other factors of the user can be considered. The fitness scheme is adjusted, stored into the local storage module, fed back finally and stored into the cloud processing module. The local processing module conducts pre-processing of the control module of the fitness equipment terminal according to the fitness scheme of the local storage module.

In the present embodiment, the fitness system also includes a data feedback unit for feeding back fitness progress data of the user. The data feedback unit acquires data from the cloud storage module. The fitness progress data of the user can be known by a trainer in real time through the unit, so as to conduct refined fitness guidance on the user. The data feedback unit can be displayed on a portable mobile terminal through a wireless communication mode.

In the present embodiment, the fitness guidance unit also includes a guidance display module connected to the local processing module. According to the fitness scheme, when the user completes the exercise of the current fitness equipment terminal, exercise guidance can be made on the user, e.g., going to a next fitness terminal for exercise.

Relative to the prior art, the fitness system of the present disclosure can customize a refined fitness scheme aiming to the identity information of the user, when the user makes fitness motion, the fitness guidance unit can recognize the identity information of the user, and acquire the corresponding fitness scheme from the fitness scheme disposal unit, and match with a flexible damping system. In the motion process, the user can make fitness motion targetedly according to fitness demands, so as to achieve efficient and refined fitness.

The above only describes preferred embodiments of the present disclosure. It should be indicated that for those ordinary skilled in the art, several improvements and variations can also be made without departing from the technical principle of the present disclosure. The above assumed improvements and variations shall also be regarded as the protection range of the present disclosure.

What is claimed is:

1. A fitness equipment, comprising a fitness equipment terminal and a data terminal; wherein the fitness equipment terminal comprises a movable member and a damping device for controlling the damping intensity of the movable member, and further comprises a travel tracking module for feeding back motion data of the damping device a control module for controlling the damping device and a posture adjustment module for automatically adjusting positions of components of the fitness equipment to adjust a sitting posture of a user; the damping device comprises an electromagnetic induction assembly; the electromagnetic induction assembly comprises a stator core, a plurality of magnetic induction coils disposed in a lengthwise direction in the stator core, and a rotor damping shaft located at one side of the plurality of magnetic induction coils; the rotor damping shaft is connected to the movable member of the fitness equipment and is configured to control the damping intensity of the movable member; a plurality of rotor magnets having magnetisms disposed oppositely in sequence are disposed on the rotor damping shaft; the rotor damping shaft realizes reciprocating motion through electrification of the plurality of magnetic induction coils; the travel tracking module is configured to track motion data of the rotor damping shaft and feed back the motion data to the control module; the data terminal is configured to transmit a fitness scheme to the control module; and the control module controls the motion of the damping device according to the fitness scheme transmitted by the data terminal, and controls and adjusts the posture adjustment module according to the fitness scheme.

2. The fitness equipment according to claim 1, wherein the travel tracking module comprises an electronic ruler and a position sensor.

3. The fitness equipment according to claim 1, wherein a power-off protection device is also disposed between the rotor damping shaft and the stator core; the power-off protection device comprises an electromagnetic switch located on the rotor damping shaft and the stator core and a buckling groove snap-fitted with ends of the electromagnetic switch, respectively; and a plurality of buckling grooves are disposed on the stator core in a direction of the rotor damping shaft.

4. A fitness system adopting the fitness equipment of claim 1, wherein the data terminal comprises a data collection unit, a fitness scheme disposal unit and a fitness guidance unit;

the data collection unit is used for collecting data for identity information of the user;

the fitness scheme disposal unit is used for receiving the identity information of the user, generating and storing a fitness scheme corresponding to the identity information according to the identity information, and adjusting the fitness scheme corresponding to the identity information in combination with the motion data when receiving the motion data corresponding to the identity information; and the fitness guidance unit is used for recognizing the identity information of the user and acquiring the fitness scheme corresponding to the identity information from the fitness scheme disposal unit.

5. The fitness system according to claim 4, wherein the data collection unit comprises a 3D physiological modelling module for conducting 3D human body modeling on the identity information of the user.

6. The fitness system according to claim 4, wherein the fitness scheme disposal unit is arranged on a remote cloud and is in communication connection with the fitness guidance unit; the fitness guidance unit comprises an identity information recognition module, a local storage module and a local processing module; after the identity information recognition module recognizes the identity information of the user, the fitness scheme corresponding to the identity information acquired from the fitness scheme disposal unit is stored in the local storage module; and the local processing module conducts pre-processing of the control module of the fitness equipment terminal according to the fitness scheme of the local storage module.

7. The fitness system according to claim 6, wherein the fitness guidance unit further comprises a manual adjustment module for adjusting the fitness scheme in the form of manual intervention.

8. The fitness system according to claim 4, wherein the fitness scheme disposal unit comprises a cloud storage module used for storing the identity information to be collected by the data collection unit, and a cloud processing module used for producing a fitness scheme according to the identity information of the user and storing the fitness scheme into the cloud storage module.

9. The fitness system according to claim 8, wherein the fitness system further comprises a data feedback unit for feeding back fitness progress data of the user; and the data feedback unit acquires data from the cloud storage module.

* * * * *